US005692884A

United States Patent [19]

Allen et al.

[11] Patent Number: 5,692,884

[45] Date of Patent: Dec. 2, 1997

[54] PUMP ASSEMBLY FOR HOT MELT TANKS

[75] Inventors: Martin A. Allen; John T. Fetcko, both of Dawsonville, Ga.

[73] Assignee: J&M Laboratories, Inc., Dawsonville, Ga.

[21] Appl. No.: 569,998

[22] Filed: Dec. 8, 1995

[51] Int. Cl.[6] ..... F04B 17/06

[52] U.S. Cl. ..... 417/361; 418/206.1; 74/110

[58] Field of Search ..... 417/361; 418/206.1; 74/110; 425/186

[56] References Cited

U.S. PATENT DOCUMENTS 1,751,646 1/1930 Nieman ..... 74/110

3,831,906 8/1974 Wakeman ..... 418/206.1

4,032,391 6/1977 Moked et al. ..... 418/206.1

5,433,593 7/1995 Berger ..... 425/186

*Primary Examiner*—Timothy Thorpe

*Assistant Examiner*—Cheryl J. Tyler

*Attorney, Agent, or Firm*—R. L. Graham

[57] ABSTRACT

A quick change pump assembly for an adhesive pumping system includes three main components: a manifold, a pump, and a motor. These components are secured to a subframe which is adapted to be detachably mounted on the mainframe of the system. The subframe with the three components mounted thereon is selectively movable between an operating position and a withdrawn position. In the withdrawn position, any of the components on the subframe may be replaced or repaired.

15 Claims, 6 Drawing Sheets

PUMP ASSEMBLY FOR HOT MELT TANKS

BACKGROUND OF THE INVENTION

This invention relates to hot melt tanks for dispensing a molten thermoplastic. In one aspect it relates to hot melt tanks which comprise a hopper and a pump connected to the hopper for dispensing the thermoplastic. In a specific aspect, the invention relates to a pump assembly which is designed to be rapidly disengaged and removed from the hopper for repair or replacement with a new assembly.

Hot melt tanks are used in a number of commercially important applications which include the application of hot melt polymer adhesives for bonding furniture parts, diaper backings, and automotive parts, to name a new. Most, if not all, hot melt tanks comprise an electrically heated hopper and a pump connected to the hopper outlet. Thermoplastic pellets are introduced into the top of the hopper wherein they are heated to a temperature above the melting point of the thermoplastic. The molten thermoplastic settles to the bottom of the hopper which has an outlet flow passage feeding into the pump. The pump draws the molten polymer from the hopper and discharges the polymer into a flow line connected to a dispensing means. Hot melt tanks have been described in U.S. Pat. No. 5,061,170.

The article of manufacture whereon the adhesive is applied may be generically referred to as the substrate. In some applications the dispensing means may comprise a flexible hose connected to the pump at one end and at the opposite end connected to a dispensing gun. The operator may manually move the gun to the bonding points on the substrate for applying the adhesive. In other applications the pump may discharge into a flow line connected to stationary spray nozzles which are directed onto a moving conveyor line. The substrate will be placed on the conveyer line and will pass under the spray nozzles. The nozzles may be oriented to discharge the adhesive onto the substrate in a desired pattern and/or be equipped with valving for selectively turning nozzles on or off to achieve the desired pattern. This is important for substrates having an irregular shape. The operation of the hot melt tank comprising the hopper and the pump is the same, whether the adhesive is applied to the substrate using dispensing means comprising a movable spray gun or stationary spray nozzles.

The operation of the pump of the hot melt tank requires peripheral devices including an electric motor which is often coupled to the pump through a gear box for speed reduction. In addition the pump usually discharges into a manifold which houses a filter and a pressure relief valve for safety. The manifold has an outlet line which discharges the molten polymer to the dispensing means. Positive displacement gear pumps of the type described in U.S. Pat. Nos. 5,061,170 and 5,236,641 have been used in hot melt tanks.

A problem in hot melt tanks of the prior art is encountered when the pump or any of the peripheral devices must be removed for repair or replacement. In this case the production line must be shut down and the faulty component removed. This is often a time consuming task due to the spatial and/or mechanical interrelationship of the components of the hot melt tank. For example, a common problem is that the pump has become plugged and needs cleaning or repair. In this instance it is generally not possible to remove the pump without also removing one or more of the peripheral components as well. The pump and peripheral components are generally mounted on a frame secured to the floor by bolts or other connectors. Thus, for replacing the pump it is usually necessary to disassemble component-bycomponent from the frame, and reverse the procedure by reassembling the assembly with a new or repaired component. The production down-time for this procedure may be on the order of six hours or more. This is the case even if a new pump is available for replacing the faulty pump since most of the down-time is associated with the removal and replacement of parts. The economic implications of this time consuming procedure are obvious.

In summary, hot melt tanks comprise a heated hopper for providing a source of molten thermoplastic often used as adhesives. The tank further comprises a pump and peripheral devices for delivering the thermoplastic to a dispensing means for applying the thermoplastic to a substrate. In prior art tanks, the procedure for replacing the pump and/or peripheral devices is complicated by the mechanical interrelationship of the tank components and results in lengthy production down-time.

SUMMARY OF THE INVENTION

The present invention provides a hot melt tank having a novel pump assembly which may be rapidly connected and disconnected to the hopper of the tank. In the event the pump or peripheral device becomes plugged or damaged, the assembly may be removed as a unit and replaced with a new assembly unit. The use of the present pump assembly reduces production down-time to a matter of minutes.

The hot melt tank of the present invention comprises a main frame with the hopper secured thereto and a pump assembly removably secured to the hopper. The pump assembly comprises a subframe having secured thereto a manifold, a gear pump, and an electric motor coupled to the pump through a gear box. The pump assembly may be attached and detached from the hopper as a unit for minimizing production down-time.

The manifold of the assembly has a mating surface which slidingly engages with a mating surface on the underside of the hopper. The manifold mating surface has a polymer inlet which registers with the hopper outlet for conducting the molten polymer to the pump of the assembly. The pump discharges the molten polymer into a flow line which conducts the polymer to a dispensing means. The dispensing means may be either a moveable dispensing gun on a flexible hose, or alternatively, stationary spray nozzles adapted to discharge onto a substrate on a moving conveyor.

The pump assembly further in a preferred embodiment includes wheels which are fixed to either side of the assembly and adapted to roll along a track formed on the main frame of the hot melt tank. The installation and/or removal of the pump assembly comprises three positions. A first position wherein the assembly is completely disengaged from the hopper and is supported on the track (e.g. by the wheels of the assembly). From the first position, the assembly is moved as a unit to the second position which is located under the hopper. In the second position the assembly is slidingly engaged with the hopper with the manifold inlet and hopper outlet in vertical alignment but slightly spaced apart in the vertical direction. The third position which is the fully engaged operational position, is achieved by moving the assembly upward as a unit whereby the spaced apart flow passages of the second position are compressed together and a fluid seal is established therebetween. Alignment means are provided whereby the polymer flow passages of the hopper and pump assembly precisely register at the interface of the hopper and the assembly. The movement of the assembly from the second to the third position is accomplished using a wedge mechanism which imparts an upward force on the assembly whereby the assembly is moved rectilinearly (i.e. it does not tilt to one side or the other or rotate) and vertically as a unit off the track and secured to the hopper for operation. For removing the pump assembly, the procedure is reversed so that the assembly moves from the third, to the second, and finally to the first position.

For removing a plugged or damaged pump assembly, a shut-off valve is provided to temporarily discontinue the flow of polymer from the hopper to the pump assembly. The plugged assembly may be rapidly removed as a unit and a replacement assembly moved into place following the steps above. The shut-off valve is then opened and production resumed within a matter of minutes. The removed assembly may then be repaired off-line for later use. The use of the present pump assembly significantly reduces the downtime associated with pump and/or pump peripheral device failure and, therefore, improves the economics of hot melt tanks.

DESCRIPTION OF THE PREFERRED EMBODIMENTS

The components of the hot melt tank and the flow of polymer therethrough are first described, followed by a detailed description of the steps and apparatus for installing or removing the pump assembly as a unit from the hot melt tank.

Hot Melt Tank and Polymer Flow

Figure 1:
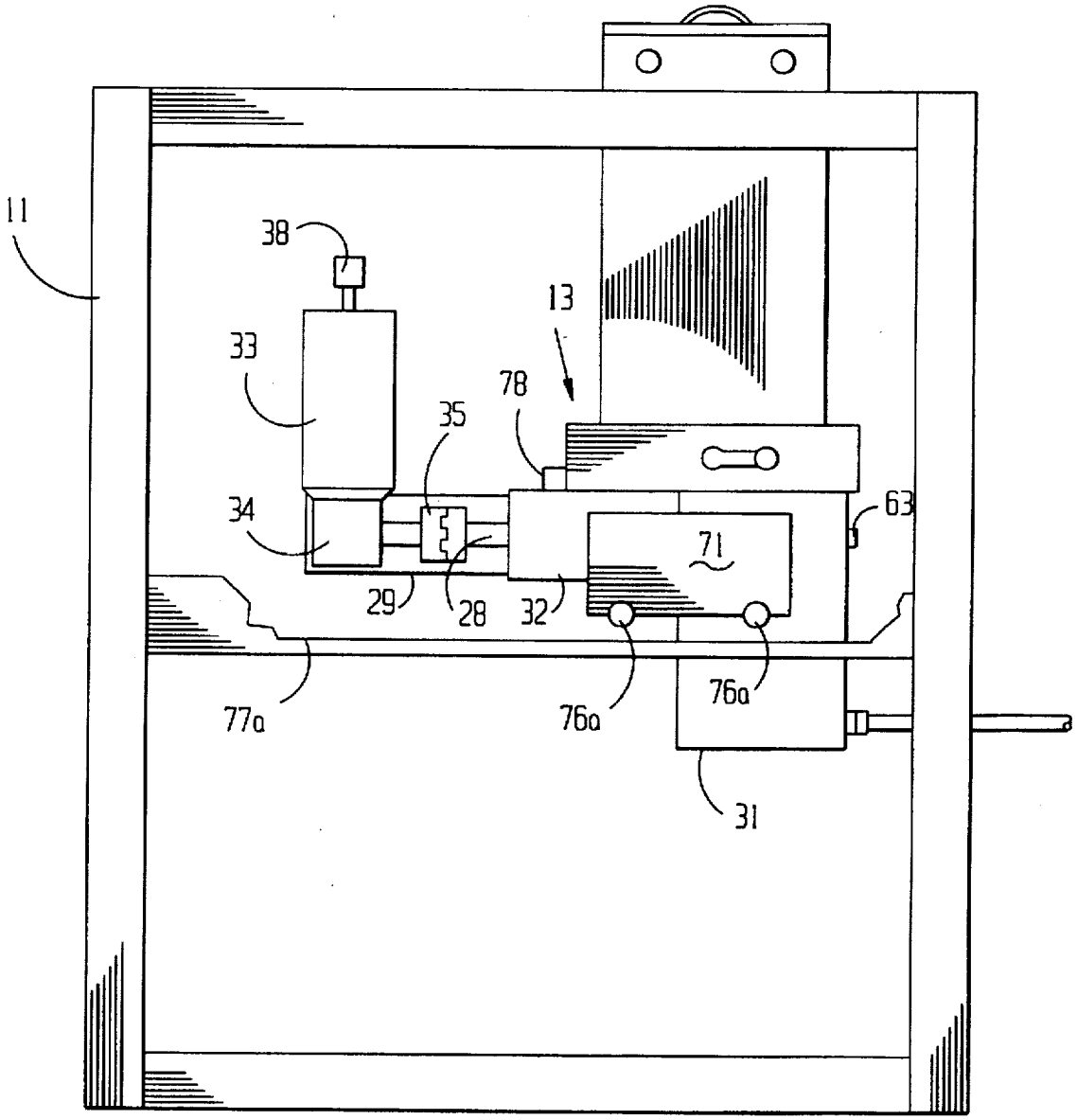
FIG. 1 is a side elevation of the pump assembly in the operating position (described as third position) with frame portions cut away to illustrate details.

Referring to FIG. 1, hot melt tank 10 comprises main frame 11, hopper 12, and pump assembly 13. Frame 11 will normally be secured to concrete flooring or the like for safety. Hopper 12 is secured to the frame using bolts as at 14. In the operating position, pump assembly 13 is detachably secured to hopper 12 as will be described.

Figure 3:
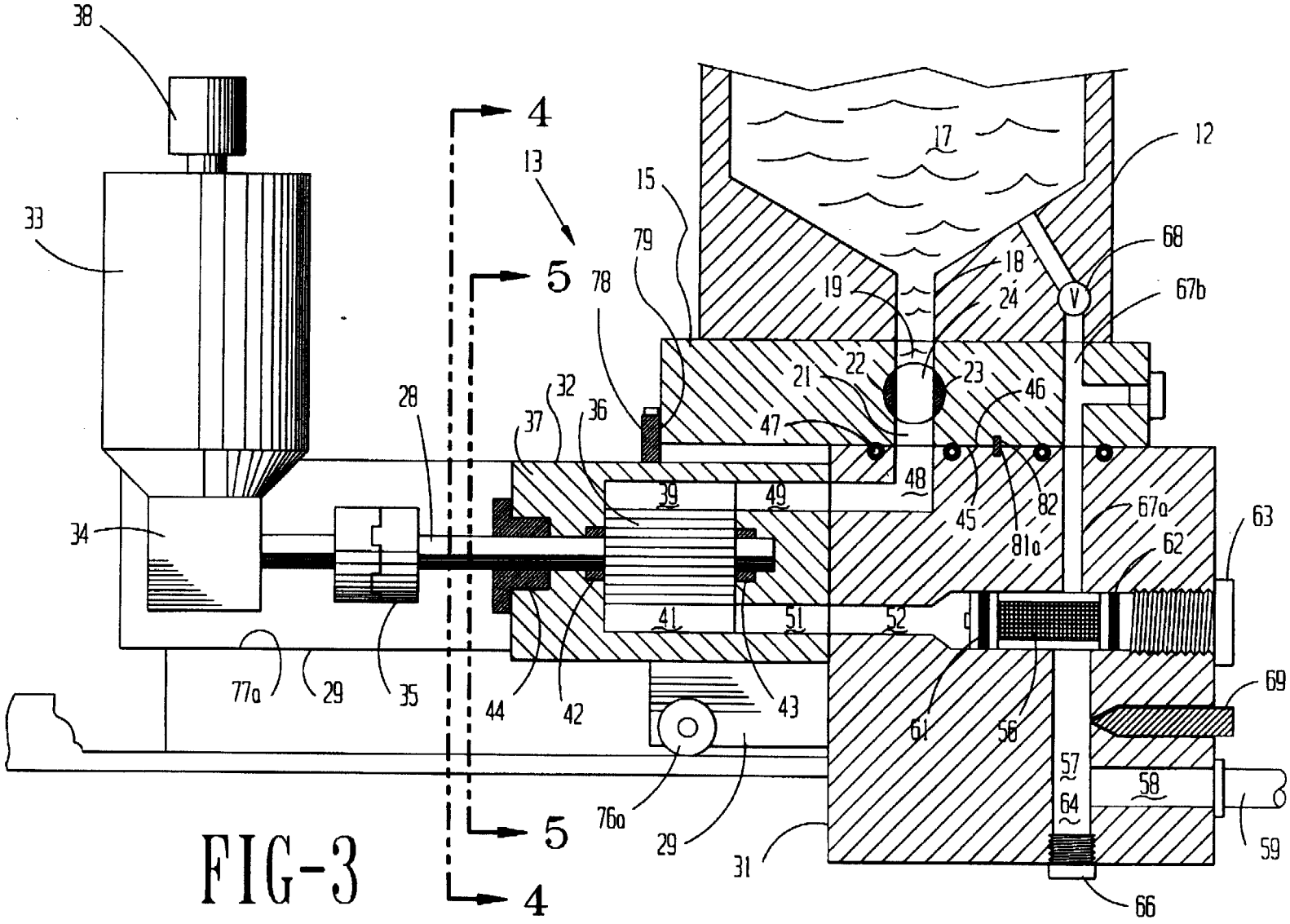
FIG. 3 is a sectional side view taken along the 3—3 of FIG. 4 of the hopper and pump assembly.
Figure 4:
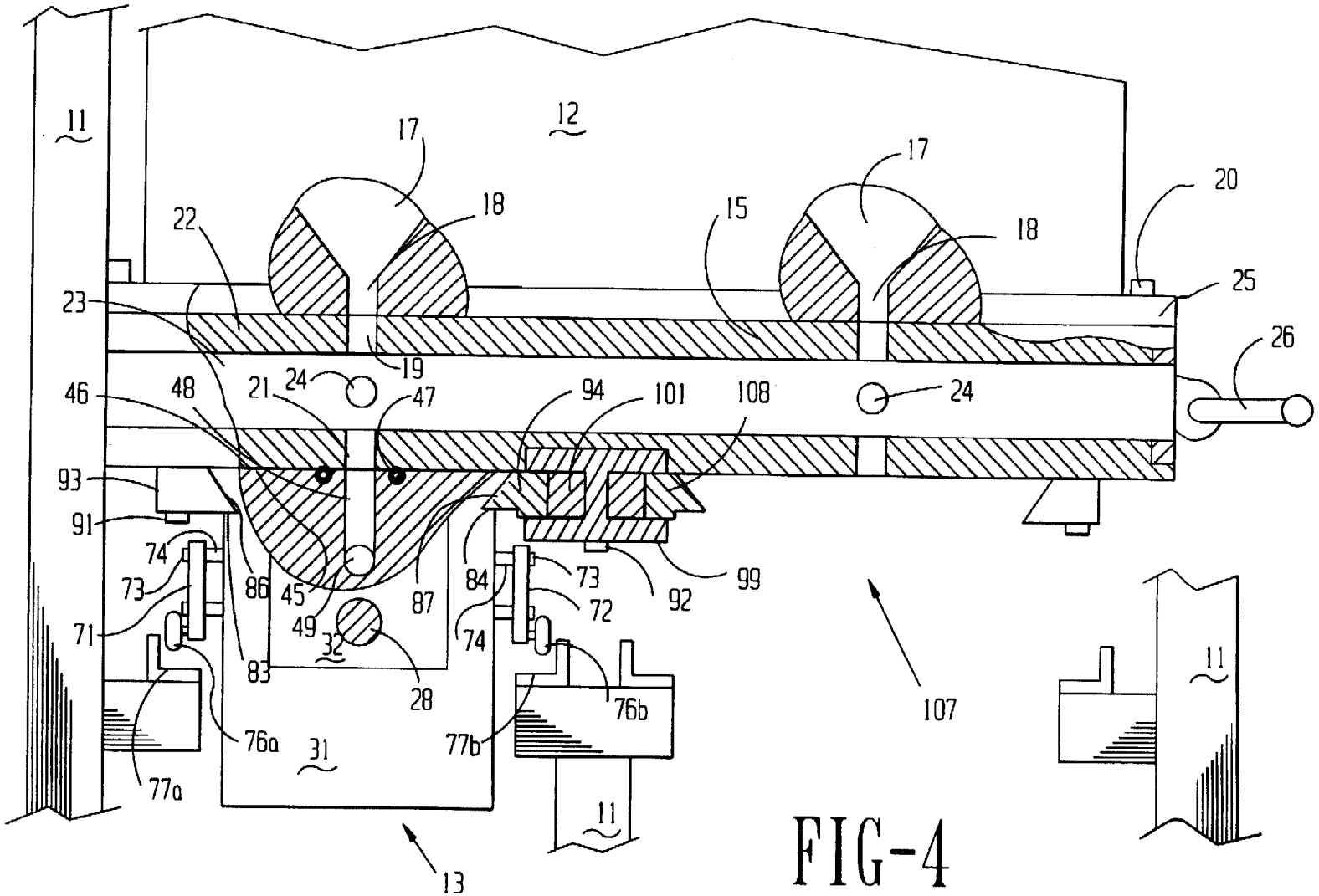
FIG. 4 is a rear partially sectional view taken along line 4—4 of FIG. 1 of the hopper and pump assembly.

FIGS. 1, 3, and 4 illustrate the pump assembly in the fully operational position (third position). As seen in the Figures, hopper 12 comprises a top portion having an inlet or lid 16 wherein solid thermoplastic pellets are introduced. The hopper comprises heating elements (not shown) which heat the hot melt thermoplastic to the molten state whereby a source of molten thermoplastic fills the bottom of the hopper in reservoir 17. Hopper 12 further comprises base plate 15 in fluid communication with reservoir 17 through passages 18 and 19. Base plate 15 has outlet passage 21 in communication with passage 19 across rod-type valve 22. As seen in FIGS. 3 and 4, rod valve 22 comprises elongate rod 23 having port 24 which registers with passages 19 and 21 with the valve in the open position. The rod is rotated 90 degrees using handle 26 to close the valve by blocking the space between passages 19 and 21. The valve is shown in the open position in FIG. 3 and in the closed position in FIG. 4. Valve 22 is provided to temporarily shut off the flow of polymer to pump assembly 13 while the assembly is being replaced as described below. Base plate 15 may be secured to hopper 12 by bolts 20 passing through flange 25. Note that in FIG. 4, the system is constructed to accommodate two pump assemblies 13, one illustrated in the first position, and the second (not shown) adapted to be inserted in space 107. Rod 23 is provided with two openings 24 (shown in the closed position), one for each pump assembly.

As best seen in FIGS. 1 and 3, pump assembly 13 comprises manifold 31, pump 32 for delivering hot melt to the manifold, electric motor 33 drivingly coupled to the pump through gear box (speed reducer) 34, shaft coupling 35, and shaft 28. As will be described below, the pump assembly 13 is mounted as a unit on a subframe, which permits the pump assembly unit to be moved relative to the main frame 11 and hopper 12.

Pump 32 comprises body 37 which is secured to manifold 31 by bolts (not shown). Motor 33 and gear box 34 may be secured to the assembly by bolting (not shown) through subframe 29 which is secured to pump 32 and manifold 31 using bolts.

Pump 32 is preferably a positive displacement pump such as a gear pump. Pump 32 has an internal cavity wherein gear 36 is rotatably disposed. Gear 36 defines inlet cavity 39 fed by inlet passage 39 and outlet cavity 41 discharging to outlet passage 51. As gear 36 rotates, polymer material in cavity 39 is entrapped in the teeth of the gear and is transferred and pressurized into cavity 41. The gear pump actually comprises a pair of counter-rotating gears which entrap the polymer between the meshed teeth of the gears. In the view of FIG. 3, the second gear is hidden by gear 36. Pump 32 is also provided with fluid seals 42 and 43 and shaft bearing 44. The preferred pump 32 is a positive displacement gear pump of the type disclosed in U.S. Pat. No. 5,236,641, the disclosure of which is incorporated herein by reference. This pump has a throughput directly proportional to pump speed. Motor 33 may be provided with electronic controls 38 to control the pump speed.

As may be seen in FIGS. 3 and 4, manifold has formed thereon a mating surface 45, which engages with mating surface 46 of base 15. Manifold 31 has formed therein inlet polymer flow passage 48 which registers with hopper outlet 21 at one end and with pump inlet 49 at the other end for conducting molten polymer from the outlet passage to pump inlet cavity 39. By means described below, the manifold is maintained in compressive contact relationship with plate 15 so that the compression between the mating surfaces 45 and 46 is sufficient to establish a fluid seal around the intersection of passages 21 and 48. O-ring 47 is provided to further establish the seal. Manifold 31 further comprises flow passage 52 which registers with pump outlet passage 51 for receiving pressurized polymer from pump outlet cavity 41. Molten polymer entering passage 51 flows through filter 56, into passages 57, through intersecting outlet passage 58 and into discharge line 59. Line 59 is connected to an external dispensing means such as a dispensing gun or dispensing nozzles. Molten polymer thus flows from reservoir 17, through passages 18 and 19, through valve port 24, through passages 21, 48, and 49, into pump cavity 39, across gear 36, into cavity 41, through passages 51 and 52, through filter 56, through passages 57 and 58, and finally into outlet line 59.

Filter 56 is a tubular filter wherein the polymer flows through the inner core of the filter and radially outward through the permeable filter walls. The filter is provided with O-rings 61 and 62 for sealing the filter ends so that the polymer must flow through the filter core. Filter 56 may be a cartridge-type filter which may be removed by unscrewing cartridge cap 63 and pulling the filter out of the manifold. Manifold 31 also has formed therein second outlet flow passage 64 which may be used as an alternative to outlet passage 58. The outlet passage not in use will be capped using a bolt 66 or other means. Manifold 31 and base 15 have formed therein by-pass lines 67*a* and 67*b*, provided with a check valve 68 for returning flow to reservoir 17. The check valve 68 may be spring loaded to maintain a minimum pressure on the by-pass line 67. Alternatively, a separate by-pass valve may be provided in line 67. The manifold may also be provided with a pressure relief valve 69 for safety.

The components of the pump assembly, base plate, and hopper should be constructed of high quality steel to resist corrosion and to withstand the high temperature operation.

Pump Assembly Subframe: Tracks and Wedge Mechanism

The subframe comprises two main parts for providing two functions: (1) tracks for supporting assembly 13; and (2) a wedge mechanism for engaging the assembly 13 to hopper 12.

Tracks:

Referring to FIGS. 1 and 4, pump assembly subframe comprises side plates 71 and 72 secured to opposite sides of the manifold 31 by bolts 73 and spacers 74. On the bottom of plates 71 and 72 are rotatably mounted wheels 76*a* and 76*b*. Main frame 11 has secured thereto parallel, horizontal track members 77*a* and 77*b* whereon the wheels (76*a* and 76*b*) guidingly roll. The tracks 77*a* and 77*b* have a portion positioned directly below the hopper 12 and extend a sufficient distance to permit the assembly 13 to be moved to a fully retracted position (see FIG. 2). Assembly 13 may thus be manually moved as a unit by pushing or pulling the unit whereby wheels 76*a* and 77*b* roll along tracks 77*a* and 77*b*, respectively, between the first and second positions. In the first position, the assembly is in a fully retracted position (FIG. 2), permitting its removal from the tracks. In the second position (FIG. 1), the assembly 13 is directly below hopper 12.

Figure 2:
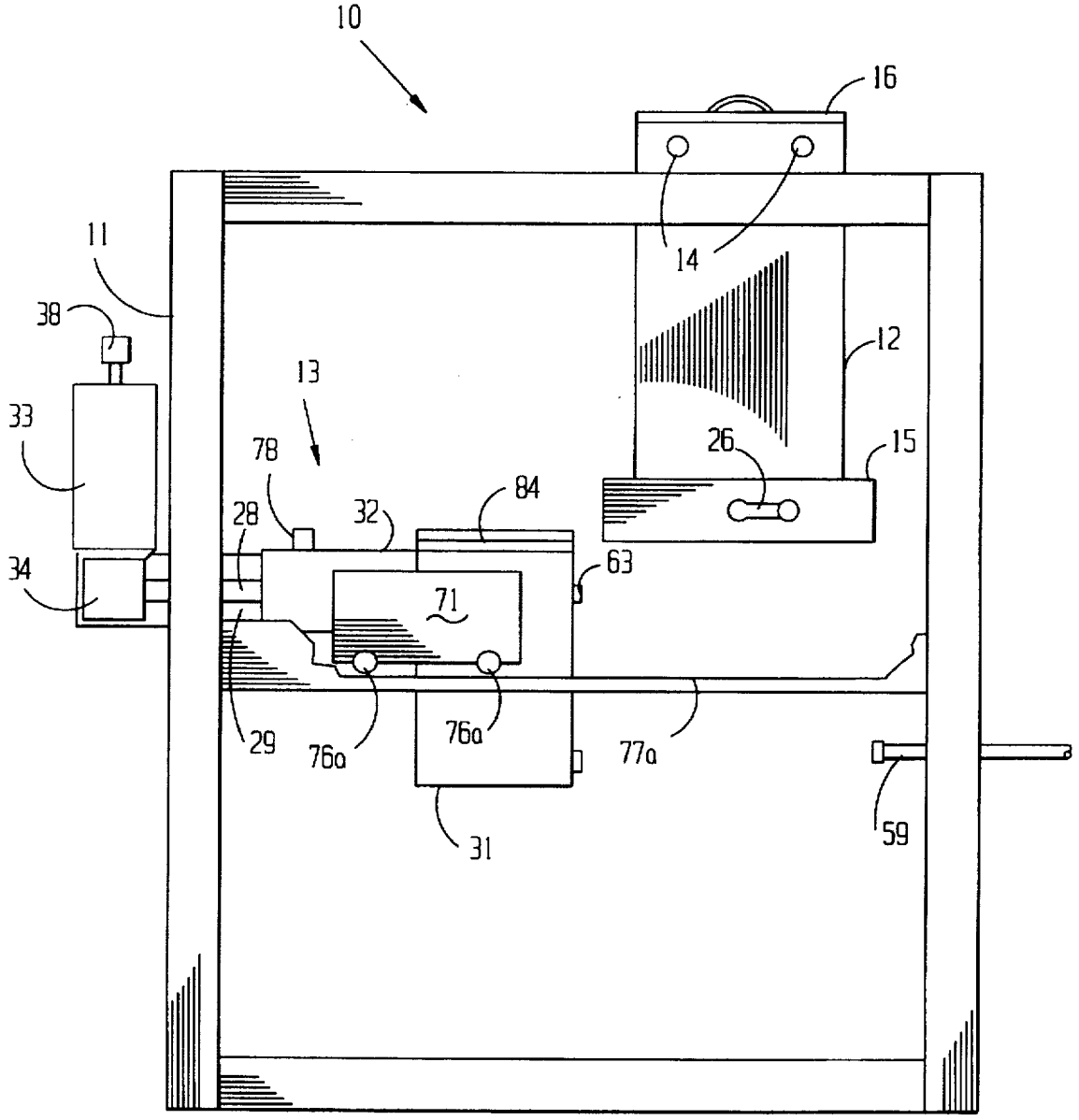
FIG. 2 is a side view similar to FIG. 1, illustrating the pump assembly in the fully disengaged position (described as first position) disconnected from the hopper.

As indicated above, and as described in more detail below, the pump assembly is selectively movable to three positions:

First Position:

In this position, the pump assembly 13 is completely detached from hopper 12 and outlet line 59 and is positioned on tracks 77*a* and 77*b* with the weight of the assembly being supported on wheels 76*a* and 76*b*. This position is illustrated in FIG. 2.

Figure 5:
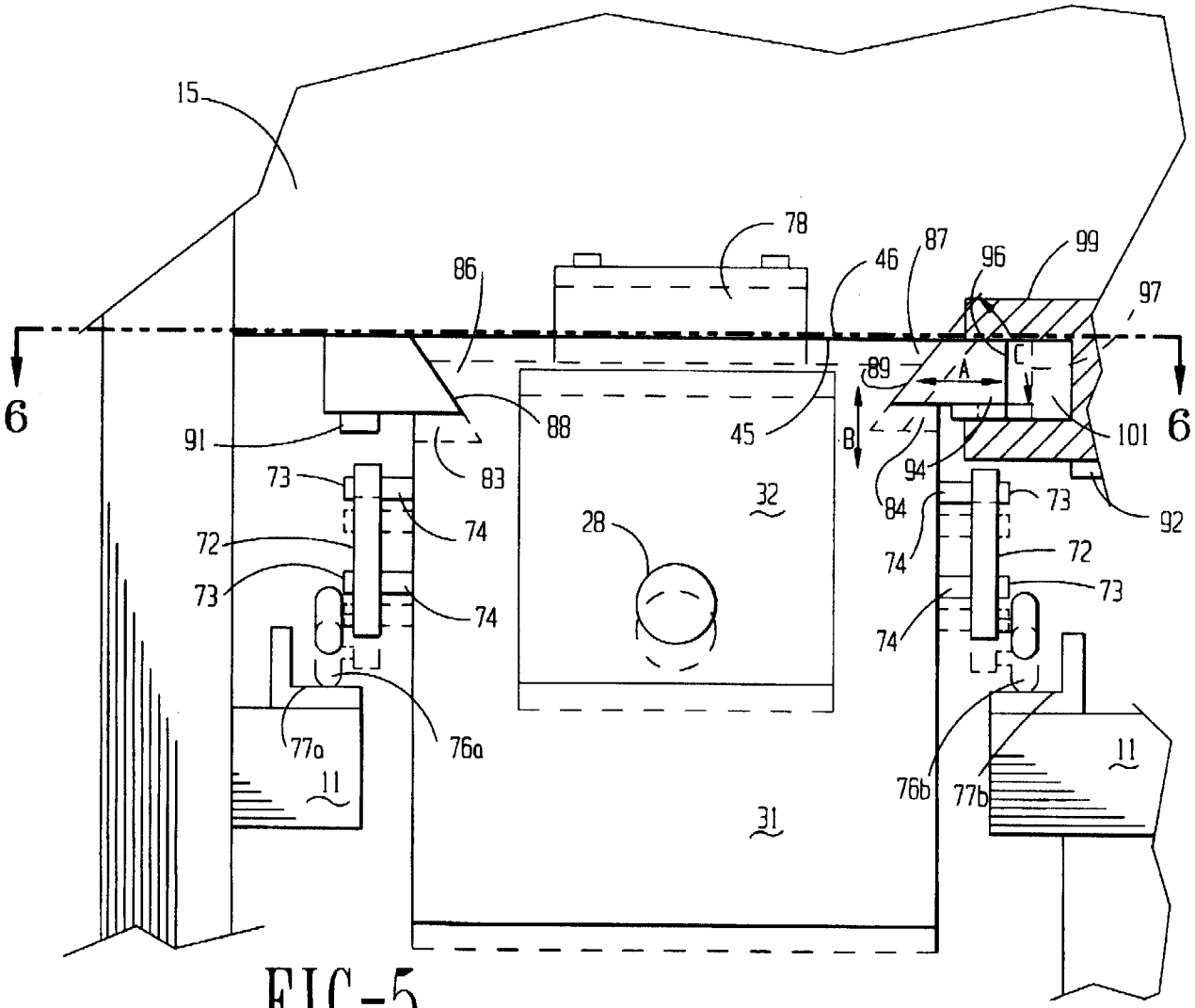
FIG. 5 is a partial sectional view taken along line 5—5 of FIG. 3 illustrating the rectilinear and vertical movement of one pump assembly from the second to the third positions.

Second Position:

In this intermediate position, pump assembly 13 is located under hopper 12 with hopper outlet 21 and manifold inlet in vertical alignment but slightly spaced apart in the vertical direction. The assembly is moved from first to second position by rolling the assembly along tracks 77*a* and 77*b* as has been described. The positioning of the assembly 13 relative to the manifold 31 for aligning hopper 12, flow passage 21, and manifold passage 48 is achieved using plate 78 mounted on the top side of pump 32 (see FIG. 3) which contacts the side of base plate 15 as at 79 with the assembly 13 in the aligned position. The second position is illustrated in FIG. 5 by the dashed lines where it is seen that wheels 76*a* and 76*b* are in contact with tracks 77*a* and 77*b*, respectively.

Third Position:

This position is the operating position of the pump assembly 13 (see FIG. 1). The third position is achieved by lifting the pump assembly from the second position whereby hopper mating surface 46 and manifold mating surface 45 are compressed together thereby establishing a fluid seal at the junction of passages 21 and 48. As described below, a wedge mechanism is used to lift the pump assembly 13 rectilinearly (i.e. it does not tilt one way or another as it moved nor does it rotate from the second to the third position. The third position is illustrated in FIG. 5 by the solid lines. FIGS. 1, 3, and 4 also illustrate the third position. As mentioned above, the positioning of the pump assembly 13 relative to hopper 12 in the rolling direction is achieved using stopper 78. For aligning flow passages 21 and 48, the precise positioning of the assembly as it is lifted and secured to the hopper may be accomplished using dowel pin 81 mounted on surface 45 and complementary shaped hole formed in surface 46.

From the foregoing it is seen that installing the pump assembly involves the steps of rolling the assembly along tracks 77*a* and 77*b* from the first position to the second position, then lifting the assembly using the wedge mechanism described below from the second position to the third position 3 whereby the assembly is secured to the hopper for operation. Removing the pump assembly involves a reversal of these steps.

Wedge Mechanism:

The movement of pump assembly 13 from the second position to the operating third position is achieved by the wedge mechanism. The mechanism which is used to move the assembly 13 upwardly, as the name suggests, operates on the kinematical principles which govern the motion of sliding wedges.

Referring to FIGS. 4 and 5, manifold 31 has machined on either side angular grooves 83 and 84 defining downward facing wedges 86 and 87, respectively. Wedges 86 and 87 are parallel and have downward facing surfaces 88 and 89, respectively. For slidingly engaging with wedges 86 and 87, hopper base 15 has secured to the underside thereof upward facing stationary wedge 93 and upward facing movable wedge 94. Wedge 93 may be attached to base 15 using bolts 91. As best seen in FIG. 5, wedge 94 is movable laterally within housing 99 in the horizontal direction as illustrated by arrow A. The housing 99 may be secured to base 15 using bolts 92. The wedge is movable between the limits illustrated by solid line 96 and the retracted position illustrated by dashed line 97 so that as the wedge moves from 97 to 96 the distance between wedges 93 and 94 decreases. With the wedge 94 in the retracted position there is sufficient clearance between wedges 93 and 94 for the pump assembly 13 to be rolled therebetween as has been described in relation to the first and second positions. As the pump assembly 13 is moved into the second position, manifold wedge 86 slidingly engages with stationary wedge 93 and the other manifold wedge 87 slidingly engages with movable wedge 94 (in the retracted position). The second position is achieved when the rolling motion is terminated by stopper 78 contacting the side of base plate 15 at 79 whereby assembly 13 is aligned with base 15 in the rolling direction by the stopper and in the direction perpendicular thereto by the engagement wedges 86 and 87 with wedges 93 and 94, respectively.

Referring now to FIG. 5, the second position is illustrated by the dashed lines, whereas the third position is illustrated by the solid lines. For lifting the assembly movable wedge 94 is driven from 97 to 96 toward stationary wedge 93 and slidingly contact wedge surface 89 of wedge 87. The wedge angle C is preferably between 30 to 60 degrees and most preferably about 45 degrees. The wedged relation of wedge 94 and surface 89 induces an upward force upon surface 89 and the unitary pump assembly 13 as a whole. The contact of wedge 94 with surface 89 also induces a sideways force away from wedge 94 which forces wedge surface 88 into sliding contact with stationary wedge 93. The wedged contact imparts an upward force on surface 88 which acts to lift the opposite side of the pump assembly. Thus wedges 93 and 94 simultaneously impart an upward force on surfaces 88 and 89, respectively, as movable wedge 94 is driven towards stationary wedge 93. The upward forces are sufficient to lift the pump assembly, and wedge 94 is driven inward a distance which compresses hopper surface 46 and manifold surface 45 with a compressive force sufficient to establish a fluid seal around passages 21 and 48. Note that with the manifold 31 in the second position, the inlet 48 is vertically aligned with passage 21.

Importantly, because of the kinematic and symmetrical configuration of engaging wedges 86 and 93 in relation to engaging wedges 87 and 94, the upward forces acting on surfaces 88 and 89 are very nearly equal whereby the assembly moves rectilinearly (i.e. it does not tilt to one side or the other) as it moves vertically upward from position 2 to position 3. As the assembly 13 and base 15 are brought together, polymer flow passage 21 is joined to passage 48 in compressive engagement. O-ring 47 is provided to further establish the sealing at the junction of the passages.

The lowering of pump assembly 13 from the third to the second position, as in removing the assembly, is accomplished by retracting wedge 94 outward from position 96 to 97 away from stationary wedge 93 whereby gravity lowers the assembly. The assembly is lowered rectilinearly with wedges 93 and 86 in sliding engagement and wedges 94 and 87 in sliding engagement. The assembly is lowered until wheels 76*a* and 76*b* contact tracts 77*a* and 77*b*. The motion of wedge 94 is controlled by the locking mechanism described below wherein wedge 94 is moved in a continuous motion so that prior to contacting the tracks, the assembly is supported on wedges 93 and 94 as it is lowered.

From the above it is seen that in both the upward and downward motions, wedge 94 moves horizontally as indicated by arrow A and assembly 13 moves rectilinearly and vertically as indicated by arrow B. As wedge 94 is driven towards the stationary wedge 93 the assembly is raised, whereas a wedge motion away from the stationary wedge lowers the assembly. The rectilinear and vertical motion of assembly 13 as wedge 94 is moved horizontally are kinematically required by the sliding wedge design.

Figure 6:
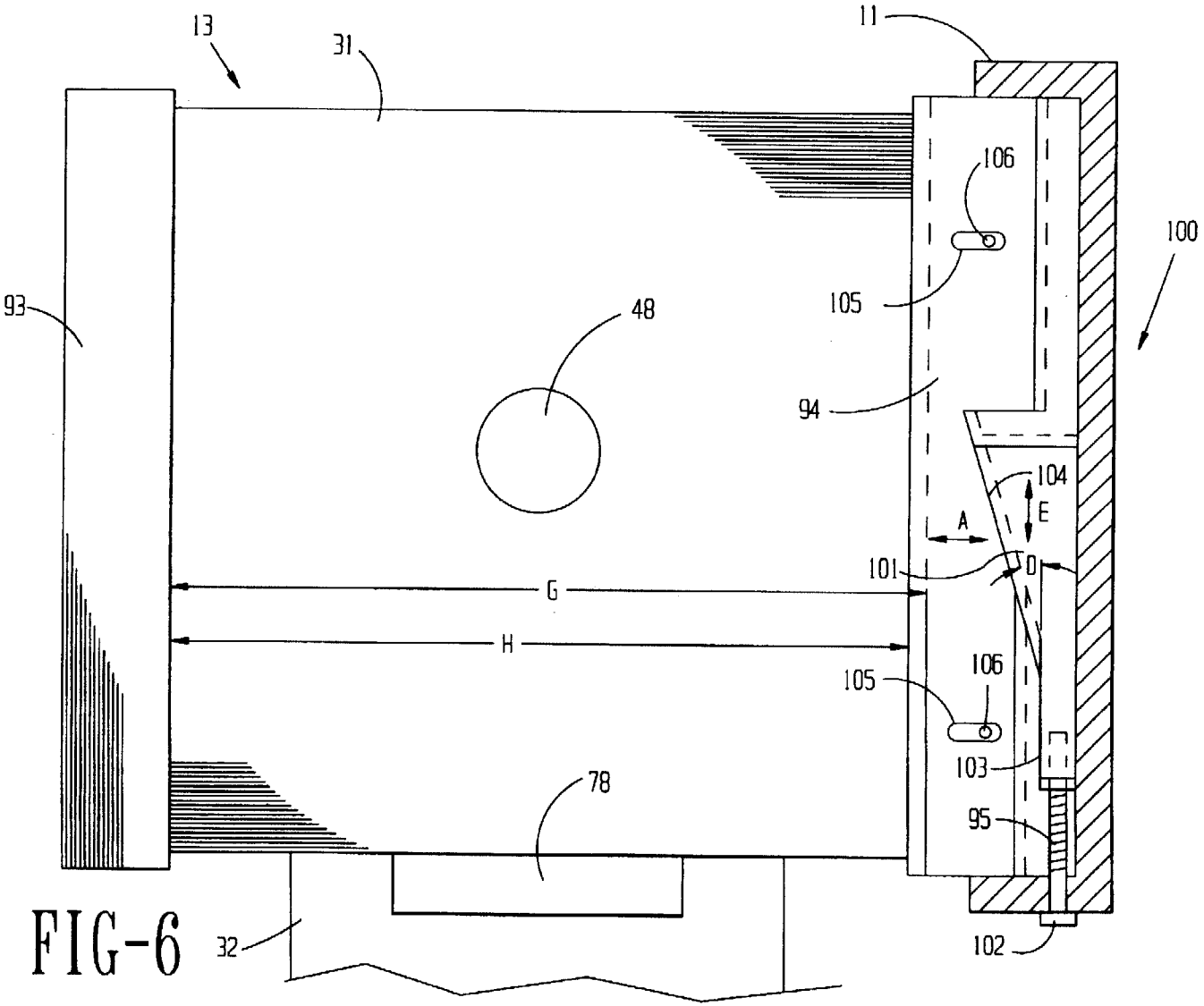
FIG. 6 is a schematic taken along line 6—6 of FIG. 5 illustrating the kinematics of the wedge mechanism for lifting the pump assembly from the second to the third position.

As best seen in FIG. 6, wedge 94 is driven from position 2 to position 3 (to the left as illustrated in FIG. 5) by a locking mechanism 100 (for simplicity of description, FIG. 6 illustrates the wedges without the manifold 31 disposed therebetween) which comprises housing 99, movable wedge 94 in sliding contact with movable locking wedge 101 along wedge surface 104, and locking bolt 102 having threads 95 threaded into end 103 of wedge 101. In both FIGS. 5 and 6, position 2 is illustrated by the dashed lines and position 3 illustrated by the solid lines. For moving wedge 94 from position 2 to position 3, locking bolt 102 is turned drawing wedge 101 to the right as viewed in FIG. 6. Due to the kinematical wedged relation at 104 between members 94 and 101, the motion of wedge 101 towards bolt 102 drives wedge 94 outward towards stationary wedge 93. Wedge 94 is provided with slots 105 which movably engage pins 106 which are fixed to housing 99. Slots 105 and pins 106 movably secure wedges 94 and 101 to the housing. Thus in the locking mechanism 100, locking wedge 101 moves in the direction E whereas wedge 94 moves perpendicular thereto in the direction A. The distance between wedges 94 and 93 may be selectively increased or decreased within the limits of slot 106. A wedge angle, labeled D in FIG. 6, of between 5 to 15 degrees is preferred with about 10 degrees is most preferred.

From the foregoing it can be appreciated that pump assembly 13 may be moved from position 2 to position 3 by the steps of turning locking bolt 102 whereby locking wedge 101 moves toward the bolt and whereby the wedged relation of members 101 and 94 kinematically requires that wedge 94 move outward towards wedge 93, thereby decreasing the distance between the wedges. The motion of wedge 94 toward wedge 93, and the slidingly wedged relation of wedges 94 and 87 as well as the slidingly wedges relation of wedges 93 and 86 requires kinematically that assembly 13 move recti-linearly and vertically upward. Thus the sliding motion of wedges 94 and 86 and that of wedges 93 and 86 occurs simultaneously at the same rate. Wedge 94 is moved towards wedge 93 to sufficiently compress hopper surface 46 and manifold surface 45 together to establish a fluid seal therebetween and to secure pump assembly 13 in the operating position.

In the downward motion from the third to the second position, bolt 102 is turned so that wedge 101 moves away from the bolt. Half of the weight of the pump assembly is supported by wedge 94 acting through wedge 87 with the remaining half supported on wedge 93 acting through wedge 86. The weight imparts an outward force on wedge 94 which drives wedge 94 away from stationary wedge 93. The motion of wedge 94 away from wedge 93, and the slidingly wedged relation of wedges 94 and 87, as well as 93 and 86, kinematically requires that the pump assembly move rectilinearly and vertically downward. It should be noted that the motion of wedges 101 and 94 is continuous as bolt 102 is turned. Therefore, as assembly 13 is raised or lowered between positions 2 and 3, the weight of the assembly is supported by the contact of wedges 86 and 87 on wedges 93 and 94, respectively.

As best seen in FIG. 4, main frame 11 may be adapted to accommodate more than a singly pump assembly by providing additional means of the type described above, whereby each pump assembly operates independently of other assemblies. FIG. 5 illustrates a frame for receiving two independent pump assemblies with only one assembly installed. A second assembly may be installed as at 107 which is equipped with independent wedge means for lifting the assembly from positions 2 to 3 as has been described. The movable wedge 94 may share a common housing 99 as illustrated in FIG. 4 wedge for 107 space being labeled 108. Wedges 94 and 108 are operated independently by turning their respective locking bolts.

While a pump assembly having a single polymer inlet and a single polymer outlet have been described, it is also possible to have an assembly having a single inlet and multiple outlets. The assembly may comprise a single inlet which splits to feed separate pumps in parallel which in turn feed each outlet independently. Alternatively, the assembly may comprise a single pump with a discharge which splits to feed multiple outlets in parallel.

The apparatus of the present invention is illustrated in FIG. 4 with separate hoppers 12. In practice one hopper may be used to feed one or more pump assemblies.

Operation

In operation, the pump assembly 13, as an integrated unit, is placed on track 77*a* and 77*b* (position 1) and moved to position 2 along the track. The manifold grooves 83 and 84 mate with wedges 93 and 94 and serve as lateral guides for positioning the manifold inlet 48 in alignment with plate passage 21. Upon reaching stop 78, the manifold inlet 48 is in longitudinal alignment (i.e. direction of manifold movement) with passage 21. Note that the other mating openings such as passage 67*a* and passage 67*b* are also in alignment with the pump assembly in the second position. The flexible hose 59 may be connected to the manifold 31 with the assembly 13 in position 1 or position 2. With the assembly 13 in position 2, the wedge mechanism is operated moving the assembly 13 to position 3. The hopper feed valve is opened placing the system in the operating position.

In replacing or repairing a defective part of the assembly, the procedure is reversed: the hopper valve is closed, the wedge mechanism is operated to move assembly 13 vertically downward to position 2, and the assembly 13 is then removed along the tracks to position 1, exposing the parts for repair or replacement. Note that check valve 68 prevents the flow from hopper 12 into the filter chamber.

Any of the hot melt adhesives may be used in the apparatus of the present invention. These include EVA's (e.g. 20–40 wt % VA). These polymers generally have lower viscosities than those used in meltblown webs. Conventional hot melt adhesives useable include those disclosed in U.S. Pat. Nos. 4,497,941, 4,325,853, and 4,315,842, the disclosures of which are incorporated herein by reference. The preferred hot melt adhesives include SIS and SBS block copolymer based adhesives. These adhesives contain block copolymer, tackifier, and oil in various ratios. The above melt adhesives are by way of illustration only; other hot melt adhesives may also be used.

Most hot melt adhesives are applied at temperatures ranging from about 270° F. to about 340° F., well within the operating temperatures of the apparatus of the present invention. In order to maintain the proper temperature through the assembly 13, electric heaters may be provided in manifold 31, in which case flexible electric lines would be connected to the heaters by conventional means.

What is claimed is:

1. A hot melt tank comprising (a) a main frame having secured thereto a track;

(b) a hopper mounted on the main frame and having an outlet passage formed in the bottom thereof;

(c) a pump assembly comprising a subframe having secured thereto (i) a manifold having inlet and outlet passages, (ii) a gear pump having inlet and outlet passages, respectively, in fluid communication with the manifold inlet and manifold outlet passages, and (iii) a motor drivingly connected to the pump, the assembly being moveable as a unit along the track from a first position wherein the assembly is disengaged from the hopper to a second position wherein the inlet of the manifold and the outlet of the hopper are in spaced-apart vertical alignment, and (d) means for selectively moving the pump assembly as a unit in (i) a rectilinearly vertical upward motion from the second position to a third position wherein the inlet passage of the manifold and outlet passage of the hopper are in sealing engagement, and (ii) a rectilinearly vertical downward motion from the third to the second position whereby the pump assembly may be moved as a unit on the track to return the assembly to the first position.

2. The hot melt tank of claim 1 wherein the means of part (d) for selectively moving the pump assembly comprises wedge means having (a) a downward facing first wedge formed along the top of one side of the manifold, and downward facing second wedge formed along the top of the opposite side of the manifold;

(b) an upward facing stationary wedge secured to the bottom of the hopper and in sliding contact with the first manifold wedge, and an upward facing movable wedge movably secured to the bottom of the hopper in sliding contact with the second manifold wedge and disposed to be movable towards or away from the stationary wedge, the upward facing wedges being disposed in wedged relation to the downward facing wedges so that (i) a decrease in the distance between the upward facing wedges kinematically requires the downward facing wedges to slidingly move vertically upward and (ii) an increase in the distance between the upward facing wedges kinematically requires the downward facing wedges to slidingly move vertically downward; and (c) means for selectively moving the movable wedge (i) towards the stationary wedge whereby the distance between the movable wedge and stationary wedge decreases, and (ii) away from the stationary wedge whereby the distance between the movable wedge and stationary wedge increases.

3. The hot melt tank of claim 2 wherein the wedge means of claim 2 of the stationary wedge and the movable wedge each have a wedge angle between 30 to 60 degrees.

4. The hot melt tank of claim 2 wherein the movable wedge comprises a second wedge in slidingly wedged contact with a locking wedge, the locking wedge having means for selectively moving the locking wedge in (i) a first direction wherein the wedged relation of the locking wedge and the movable wedge kinematically requires the movable wedge to move towards the stationary wedge, and (ii) a second direction wherein the locking wedge movement kinematically requires the movable wedge to move away from the stationary wedge.

5. The hot melt tank of claim 4 wherein the locking wedge has a wedge angle between 5 to 15 degrees.

6. A hot melt tank for dispensing a molten polymer comprising (a) a main frame having secured thereto a horizontal track;

(b) a hopper mounted on the main frame and having an outlet formed in the bottom thereof;

(c) a pump assembly comprising a subframe having secured thereto (i) a manifold having an inlet and an outlet, (ii) a gear pump in fluid communication with the manifold inlet and manifold outlet, (iii) a motor drivingly connected to the pump, and (iv) wheels guidingly disposed to roll along the main frame track, the assembly being movable as a unit along the track from a first position wherein the assembly is disengaged from the hopper to a second position wherein the inlet of the manifold and the outlet of the hopper are in spaced-apart vertical alignment; and (d) wedge means for selectively moving the pump assembly as a unit in (i) a rectilinearly vertical upward motion from the second position to a third position wherein the inlet of the manifold and outlet of the hopper are in sealing engagement, and (ii) a rectilinearly vertical downward motion from the third to the second position whereby the pump assembly may be moved as a unit on the track to return the assembly to the first position.

7. The hot melt tank of claim 6 wherein the wedge means of part (d) for selectively moving the pump assembly comprises (a) a downward facing first wedge formed along the top of one side of the manifold, and a downward facing second wedge formed along the top of the opposite side of the manifold;

(b) an upward facing stationary wedge secured to the bottom of the hopper and in sliding contact with the first manifold wedge, and an upward facing movable wedge movably secured to the bottom of the hopper in sliding contact with the second manifold wedge and disposed to be movable towards or away from the stationary wedge, the upward facing wedges being disposed in wedged relation the downward facing wedges so that (i) a decrease in the distance between the upward facing wedges kinematically requires the downward facing wedges to slidingly move vertically upward and (ii) an increase in the distance between the upward facing wedges kinematically requires the downward facing wedges to slidingly move vertically downward; and (c) means for selectively moving the movable wedge (i) towards the stationary wedge, whereby a force having a vertically upward component is imparted by the movable wedge on the second manifold wedge and a simultaneous upward force is imparted by the stationary wedge on the first manifold wedge, the kinematic relation of the wedges requiring the assembly to move rectilinearly and vertically upward under the action of the forces, and (ii) away from the stationary wedge kinematically requiring the first wedge to move slidingly downward on the stationary wedge and the second wedge to move slidingly downward ont the movable wedge whereby the assembly moves rectilinearly and vertically downward under the action of gravity.

8. The hot melt tank of claim 7 wherein the wedges of the manifold are slidingly engaged with the wedges secured to the hopper with the assembly in the second position and slidingly disengaged in the first position.

9. The hot melt tank of claim 7 wherein the movable wedge comprises a second wedge surface in slidingly wedges contact with a locking wedge, the locking wedge having means for selectively moving the locking wedge in a first direction and in a second direction opposite thereto, the wedged relation of the locking wedge and the movable wedge kinematically requiring the movable wedge to more towards the stationary wedge as the locking wedge moves in the first direction and away from the stationary wedge as the locking wedge moves in the second direction.

10. A hot melt pumping apparatus comprising (a) a main frame;

(b) a subframe;

(c) a hopper having an outlet passage and means for melting hot melt adhesive therein;

(d) a pump assembly mounted on the subframe as an integral unit comprising (i) a manifold having an inlet flow passage and an outlet flow passage formed therein, (ii) a positive displacement pump having an inlet in registry with the inlet flow passage of the manifold, and an outlet in registry with the outlet flow passage of the manifold, and (iii) a motor for operating the pump;

(e) a first means for selectively moving the subframe with the pump assembly mounted thereon between (i) a first position wherein the pump assembly is fully detached from the hopper and horizontally retracted therefrom, and a second position wherein the manifold is positioned under but vertically displaced from the hopper, with the hopper outlet passage in vertical alignment with the inlet passage of the manifold; and (f) a second means for selectively moving the subframe with the pump assembly mounted thereon vertically between the second position and a third position wherein the manifold is in engagement with the hopper with the outlet passage of the hopper being in registry with the inlet passage of the manifold, whereby molten hot melt adhesive flows from the hopper through the inlet passage of the manifold, through the pump and through the outlet passage of the manifold.

11. The pumping apparatus of claim 10 wherein the first means for moving the pump assembly between the first and second positions comprising a horizontal track mounted on the main frame for movingly supporting the pump assembly, said pump assembly being movable horizontally along the track between the first and second positions.

12. The pumping apparatus of claim 11 wherein the means for moving the pump assembly between the second and third positions comprises (i) parallel and horizontal grooves formed on opposite sides of the manifold, said grooves each having a downwardly facing tapered surface, and (ii) a longitudinal wedge member mounted in each groove and having an upwardly facing tapered surface for engaging the downwardly facing tapered surface of its associated groove, and (iii) means for moving at least one of the wedge members toward the other wedge member whereby the manifold is moved vertically upward by action of the upwardly facing surface acting on the downwardly facing surfaces.

13. The apparatus of claim 10 wherein the apparatus further comprises a valve mounted in the hopper outlet passage for closing the hopper outlet passage.

14. The apparatus of claim 10 wherein the manifold outlet passage has a filter mounted therein.

15. The apparatus of claim 14 wherein the manifold has a bypass passage extending from the filter to the hopper and a check valve mounted in the bypass passage.

* * * * *